US006073538A

United States Patent [19]

Tomesani

[11] Patent Number: 6,073,538

[45] Date of Patent: Jun. 13, 2000

[54] RECIPROCATING COMPRESSOR

[76] Inventor: Giordano Tomesani, Via Colunga 18-40068, San Lazzaro di Savena, Italy

[21] Appl. No.: 08/980,029

[22] Filed: Nov. 26, 1997

[30] Foreign Application Priority Data

Dec. 19, 1996 [IT] Italy ..... TO96A1047

[51] Int. Cl.[7] ..... F01B 31/10

[52] U.S. Cl. ..... 92/155; 92/165 R

[58] Field of Search ..... 92/155, 168 R, 92/248, 165 R

[56] References Cited

U.S. PATENT DOCUMENTS

| | | | |
|---|---|---|---|
| 3,149,543 | 9/1964 | Naab | 92/155 |
| 3,814,445 | 6/1974 | Bitzan | 92/155 |
| 3,921,988 | 11/1975 | Prasse et al. | 92/155 |
| 3,961,869 | 6/1976 | Droege, Sr. et al. | 92/171.1 |
| 4,050,360 | 9/1977 | Powers et al. | 92/127 |
| 5,711,206 | 1/1998 | Goettel | 92/168 |

*Primary Examiner*—Thomas E. Denion

[57] ABSTRACT

A reciprocating compressor in which the piston is axially movable within a cylindrical cavity formed on an aluminium cylinder; the piston being provided with a sealing element made from composite plastics material, an oil-scraper element made from cast iron, and a guide element made from composite plastics material; the sealing element being disposed in a first seat formed in the side wall of the piston close to an upper surface of the piston, the guide element being disposed in a second seat formed in the side wall of the piston close to a lower edge of the piston, and the oil-scraper element being disposed in a third seat formed in the side wall of the piston between the first and second seats.

4 Claims, 2 Drawing Sheets

RECIPROCATING COMPRESSOR

BACKGROUND OF THE INVENTION

The present invention concerns a reciprocating compressor, in particular a compressor having lubricated pistons.

Compressors having lubricated pistons currently in use include a crankcase within which the drive shaft of an engine is rotatably mounted, one or more cylinders fixed to the said crankcase, each provided with an associated cylindrical cavity in communication with the crankcase itself, and a head fixed to the top of each cylinder to close one end of the said cylindrical cavity with a fluid-tight seal.

The said compressors also include a piston associated with each cylinder, which piston is axially moveable within the cylindrical cavity and defines, together with its cylinder and the associated head, a fluid-tight chamber, and is moved by the said drive shaft by means of a crank and connecting rod assembly to vary the volume of the said fluid-tight chamber in such a way as to draw a fluid through an inlet valve on the head, to compress the said fluid and, finally, to expel the fluid from the variable-volume chamber through an outlet valve on the head.

In order to guarantee that the variable-volume chamber is fluid-tight, the piston has an annular sealing element or ring disposed coaxially with the axis of the piston and cylinder within a seat formed on a side wall of the piston itself, and capable of sliding on the side wall of the cylindrical cavity to prevent fluid leaking from the said chamber. This seat is formed close to the upper surface of the piston facing the cylinder head.

Furthermore, as the side walls of the cylindrical cavity are bathed with lubricating oil to facilitate the sliding of the piston in the associated cylinder, the piston has an annular oil-scraper ring disposed coaxially with the axis of the piston and cylinder within a seat formed in the side wall of the piston itself, capable of sliding over the side wall of the cylindrical cavity to prevent lubricating oil leaking into the fluid-tight chamber and damaging the head.

Currently, both the sealing ring and the oil-scraper ring are made from cast iron, hence the cylinder must be made from an extremely wear-resistant material, for example, cast iron, so that it is able to withstand the sliding without being damaged. In fact, by having to prevent the passage of the pressurised fluid into the crankcase, the cast iron sealing element exerts a significant pressure on the wall of the cylindrical cavity such that, if the cylinder is formed from an insufficiently hard material (such as, for example, aluminium), the walls themselves could become scored allowing either the pressurised fluid or the lubricating oil to pass along, irreparably damaging the compressor.

Unfortunately, making the cylinder from a hard and wear-resistant material such as cast iron is relatively expensive and leads to a significant increase in the production costs of compressors having lubricated pistons.

SUMMARY OF THE INVENTION

The object of the present invention is therefore to produce a compressor having lubricated pistons, free from the disadvantages described above.

According to the present invention there is provided a reciprocating compressor including at least one cylinder having a cavity, at least one piston axially movable within the said cavity, and at least one head fixed to the cylinder to close one end of the said cavity and define, together with the cylinder and the piston, a variable-volume chamber; the piston having sealing means for making the said variable-volume chamber fluid-tight and cleaning means for removing lubricating fluid from a lateral surface of the said cavity; the said reciprocating compressor being characterised in that the said cylinder is formed from aluminium and in that the said sealing means include a sealing element formed from plastics material.

BRIEF DESCRIPTION OF THE DRAWINGS

The present invention will now be described with reference to the accompanying drawings which illustrate a non-limitative embodiment, in which.

DETAILED DESCRIPTION OF THE INVENTION

Figure 1:
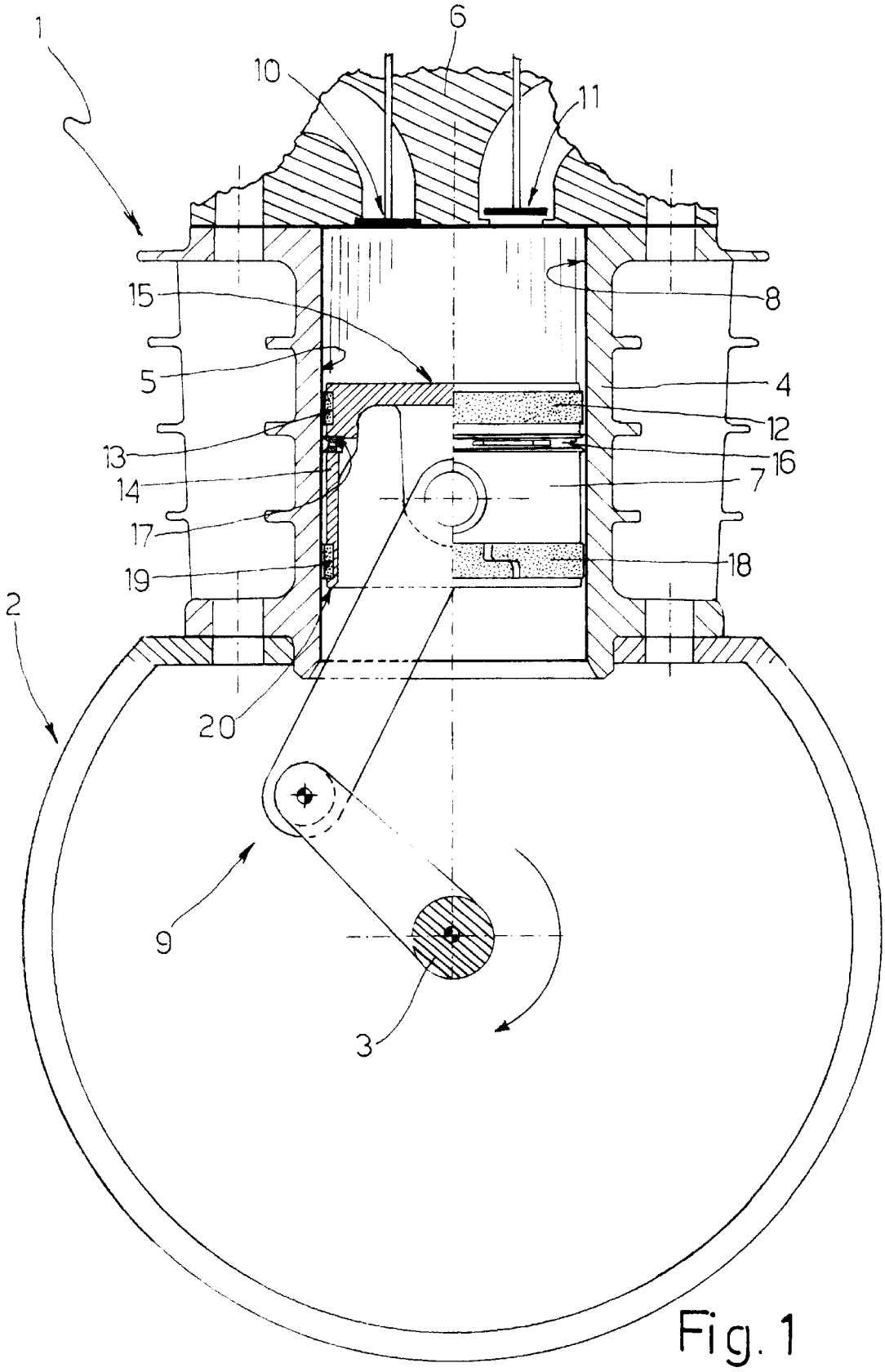
FIG. 1 is a view, with parts in section and parts removed for clarity, of a compressor having lubricated pistons formed according to the present invention.

With reference to FIG. 1, the reference numeral 1 generally indicates a reciprocating compressor which includes a crankcase 2 of known type within which a drive shaft 3 of an engine (not shown) is rotatably mounted, and at least one aluminium cylinder 4 supported by the crankcase 2 and provided with a cavity 5 which is preferably, but not necessarily, cylindrical and in communication with the crankcase 2. In particular, the cylinder 4 preferably, but not necessarily, has fins to encourage heat exchange with the external environment.

For each cylinder 4, the compressor 1 also includes a head 6 of known type fixed to the top of the cylinder 4 to close an end of the cylindrical cavity 5 with a fluid-tight seal, and a metal piston 7 axially moveable within the cylindrical cavity 5 which defines, together with the cylinder 4 and the head 6, a fluid-tight chamber 8, and is moved by the drive shaft 3 by means of a crank and connecting rod assembly 9 to vary the volume of the chamber 8. In particular, the piston 7 is preferably, but not necessarily, made from aluminium.

The head 6 has an inlet valve 10 (of known type) through which a fluid is conveyed into the chamber 8 when the piston 7 moves away from the head 6 to increase the volume of the chamber 8, and an outlet valve 11 (of known type) through which the fluid is conveyed from the chamber 8 after having reached a predetermined pressure; the pressure increase being caused by the reduction in volume of the chamber 8 due to the movement of the piston 7 towards the head 6.

In order to ensure that the variable-volume chamber 8 is fluid-tight, the piston 7 has an annular sealing element or ring 12 formed from plastics material, disposed coaxially with the axis of the piston 7 and the cylindrical cavity 5 within a seat 13 formed on a side wall 14 of the piston 7 itself, close to an upper surface 15 of the piston 7 facing the head 6. In particular, the annular sealing ring 12 is capable of sliding on the lateral surface of the cylindrical cavity 5 to prevent fluid passing from the chamber 8 into the crankcase 2.

In addition, since the lateral surface of the cylindrical cavity 5 is bathed with lubricating oil to facilitate the sliding of the piston 7 within the associated cylinder 4, the piston 7 has an annular oil-scraper element 16 formed from metal (preferably, but not necessarily, cast iron) disposed coaxially with the axis of the piston 7 and the cylindrical cavity 5 within a seat 17 formed in the side wall 14 of the piston 7 below the seat 13 of the annular sealing element 12. In particular, the annular oil-scraper element 16 is capable of sliding on the lateral surface of the cylindrical cavity 5 to remove the lubricating oil and prevent it leaking into the chamber and damaging the head 6.

The sealing ring 12 is preferably, but not necessarily, formed from a composite plastics material with a polytetrafluoroethylene (PTFE) base, possibly filled with graphite or bronze.

With reference to FIG. 1, in order to prevent the piston 7 coming into contact with the lateral surface of the cylindrical cavity 5, the piston 7 is preferably, but not necessarily, provided with an annular guide element 18 which is substantially the same as the sealing ring 12, and is disposed coaxially with the axis of the piston 7 and the cylindrical cavity 5 in a seat 19 formed on the side wall 14 of the piston 7 close to a lower edge 20 of the piston 7.

Figure 2:
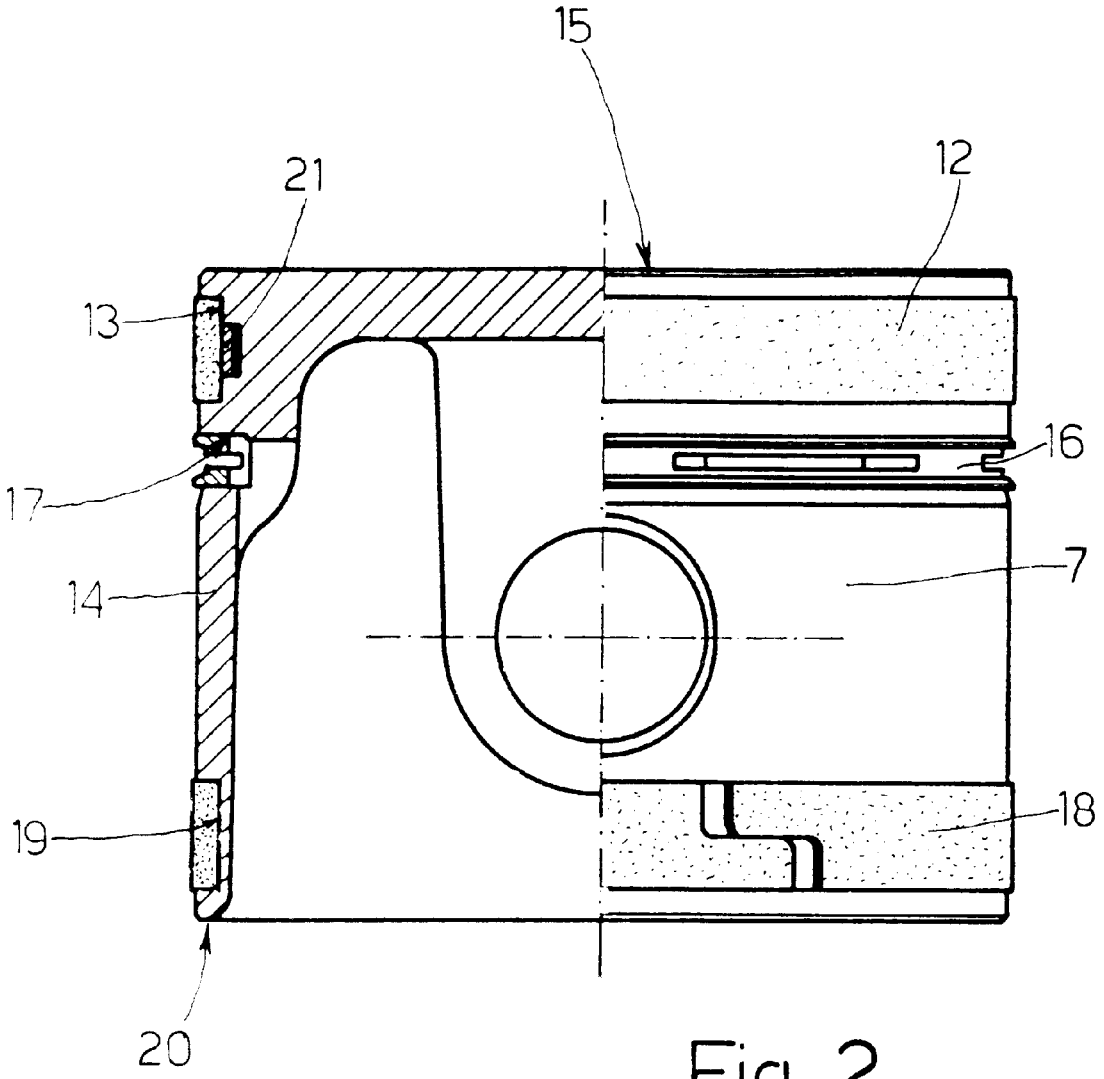
FIG. 2 illustrates a variant of a detail of FIG. 1.

With reference to the embodiment illustrated in FIG. 2, the piston 7 may be provided with a resilient thrust element 21 disposed in the seat 12 between the sealing ring 12 and the side wall 14 of the piston 7, and capable of compressing the annular element 12 itself against the lateral surface of the cylindrical cavity 5.

The operation of the compressor 1 can easily be understood from the above description and does not therefore require further explanation.

The main advantage of the compressor 1 described above is that it uses a sealing ring 12, and possibly an annular guide element 18, made of plastics material which ensures an effective seal without damaging the lateral surface of the cylindrical cavity 5, hence it is possible to form the cylinder 2 from aluminium without prejudicing the reliability of the compressor 1, and with significant economic advantages.

A further advantage derives from the fact that the annular elements 12, 18 are more durable than the metal annular elements, therefore increasing the time period between successive maintenance operations, and thus significantly reducing operating costs. Finally, a further reduction in costs arises from the lower cost of producing the annular element from plastics material instead of metal.

Finally, it is clear that modifications and variations may be introduced into the compressor 1 described and illustrated here, without by this departing from the ambit of the present invention.

I claim:

1. A reciprocating compressor (1) including at least one cylinder (4) having a cavity (5), at least one piston (7) axially moveable within the said cavity (5), and at least one head (6) fixed to the cylinder (4) to close an end of the said cavity (5) and define, together with the cylinder (4) and the piston (7), a variable-volume chamber (8); the piston (7) being provided with sealing means (12) to make said variable-volume chamber (8) fluid-tight, and cleaning means (16) to remove lubricating fluid from a lateral surface of the said cavity (5);

wherein the said cylinder (4) is formed from aluminum, wherein said sealing means (12) comprise a sealing element (12) formed from plastic material, wherein said piston (7) includes guide means (18) formed from plastics material for preventing contact between the piston (7) and the lateral surface of said cavity (5), and wherein said cleaning means (16) comprise an oil-scraper element (16) made from metal, said oil-scraper element (16) being positioned between said sealing element (12) and said guide element (18).

2. A reciprocating compressor according to claim 1, wherein said sealing means (12) comprise at least one resilient thrust element (21) capable of pressing said sealing element (12) against the lateral surface of said cavity (5).

3. A reciprocating compressor according to claim 1, wherein said sealing element (12) is formed from a composite plastic material including polytetrafluoroethylene.

4. A reciprocating compressor according to claim 1, in which the said guide element (18) is formed from a composite plastic material including polytetrafluoroethylene.

* * * * *

UNITED STATES PATENT AND TRADEMARK OFFICE

CERTIFICATE OF CORRECTION

PATENT NO. : 6,073,538
DATED : June 30, 2000
INVENTOR(S) : Tomesani

It is certified that error appears in the above-identified patent and that said Letters Patent is hereby corrected as shown below:

Entry "[76] Inventor: Giordano Tomesani, Via Colunga 18-40068, San Lazzaro di Savena, Italy," should be -- [76] Inventor: Giordano Tomesani, Crespellano, Italy --.

After entry [76], insert -- [73] Assignee: Nuova Dari S.p.A. Via Colunga 18, 40068 San Lazzaro Di Savena, Italy --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*